US008307979B2

(12) United States Patent
Yuille

(10) Patent No.: US 8,307,979 B2
(45) Date of Patent: Nov. 13, 2012

(54) SANITARY TOOTHBRUSH STORAGE APPARATUS

(76) Inventor: Robert Clifford Yuille, Dartmouth (CA)

( * ) Notice: Subject to any disclaimer, the term of this patent is extended or adjusted under 35 U.S.C. 154(b) by 99 days.

(21) Appl. No.: 12/675,612

(22) PCT Filed: Aug. 28, 2008

(86) PCT No.: PCT/CA2008/001515

§ 371 (c)(1),
(2), (4) Date: Apr. 12, 2010

(87) PCT Pub. No.: WO2009/026698

PCT Pub. Date: Mar. 5, 2009

(65) Prior Publication Data

US 2010/0314273 A1 Dec. 16, 2010

(30) Foreign Application Priority Data

Aug. 28, 2007 (CA) ..... 2599061

(51) Int. Cl.
*B65D 81/24* (2006.01)

(52) U.S. Cl. ..... 206/209.1; 206/362.2

(58) Field of Classification Search ..... 206/209.1, 206/362.2, 362.1, 362.3, 209, 363, 370, 581
See application file for complete search history.

(56) References Cited

U.S. PATENT DOCUMENTS

| | | | | |
|---|---|---|---|---|
| 1,084,965 A | | 1/1914 | Roberts | |
| 1,102,284 A | * | 7/1914 | Miller | 206/362 |
| 1,138,523 A | | 5/1915 | Withcombe | |
| 1,448,231 A | | 3/1923 | Morrison | |
| 1,562,348 A | | 11/1925 | Lockery | |
| 3,904,362 A | | 9/1975 | DiPaolo | |
| 4,473,152 A | * | 9/1984 | Jump et al. | 206/209.1 |
| 4,915,219 A | * | 4/1990 | Ottimo | 206/209.1 |
| 5,086,916 A | * | 2/1992 | Gray | 206/209.1 |
| 5,107,987 A | | 4/1992 | Palazzolo et al. | |

(Continued)

FOREIGN PATENT DOCUMENTS

CA 1299539 4/1992

(Continued)

OTHER PUBLICATIONS

PCT International Search Report, International Application No. PCT/CA2008/001515, International filing date Aug. 28, 2008, dated Dec. 17, 2008.

(Continued)

*Primary Examiner* — Jacob K Ackun
(74) *Attorney, Agent, or Firm* — MacMillan, Sobanski & Todd, LLC

(57) ABSTRACT

A sanitary toothbrush storage apparatus is provided, which comprises at least one holding compartment so shaped and dimensioned as to conveniently accommodate a toothbrush. The compartment may be juxtaposed with one or more other compartments disposed in such spaced relationship as to receive a plurality of toothbrushes. The compartments accommodate an aqueous antiseptic solution of an amount sufficient to immerse at least a substantial portion of the toothbrush head such that when awaiting further use, the toothbrush head is hygienically stored in a manner sought to inhibit environmental contamination. Separate holding compartments may be arranged in juxtaposed relationship to house small hygiene implements in hygienic conditions in readiment for further use.

14 Claims, 5 Drawing Sheets

U.S. PATENT DOCUMENTS

| | | | | |
|---|---|---|---|---|
| 5,127,521 | A * | 7/1992 | Bourque | 206/362.1 |
| 5,377,824 | A | 1/1995 | Seymour | |
| 5,566,823 | A * | 10/1996 | Summers | 206/209.1 |
| 6,119,854 | A | 9/2000 | Prentice et al. | |
| 6,135,279 | A | 10/2000 | Dryer | |
| 6,360,884 | B1 * | 3/2002 | Smith et al. | 206/209.1 |
| 6,966,441 | B2 | 11/2005 | Barham et al. | |
| 7,951,343 | B1 * | 5/2011 | Davis | 422/300 |
| 2002/0121449 | A1 | 9/2002 | Bowie | |
| 2004/0129580 | A1 | 7/2004 | Cochran et al. | |
| 2005/0279663 | A1 * | 12/2005 | Citrigno | 206/362.1 |
| 2006/0204416 | A1 | 9/2006 | Hayes et al. | |

FOREIGN PATENT DOCUMENTS

| | | | |
|---|---|---|---|
| CA | 2314748 | A1 | 7/2001 |
| CA | 2510929 | A1 | 12/2006 |

OTHER PUBLICATIONS

PCT Written Opinion of the International Searching Authority, International Application No. PCT/CA2008/001515, International filing date Aug. 28, 2008, dated Dec. 17, 2008.

* cited by examiner

SANITARY TOOTHBRUSH STORAGE APPARATUS

CROSS-REFERENCE TO RELATED APPLICATIONS

This application is the National Phase of International Application PCT/CA2008/001515 filed Aug. 28, 2008 which designated the U.S. That International Application was published in English under PCT Article 21(2) on Mar. 5, 2009 as International Publication Number WO 2009/026698A1. PCT/CA2008/001515 claims priority to Canadian Patent Application No. 2,599,061 filed Aug. 28, 2007. Thus the subject nonprovisional application also claims priority to Canadian Patent Application No. 2,599,061 filed Aug. 28, 2007. The disclosures of both applications are incorporated herein by reference.

FIELD OF THE INVENTION

The present invention relates generally to a toothbrush storage device. More specifically, it relates to an apparatus that allows for the storage of toothbrushes in an antiseptic aqueous solution, providing a clean, sterile environment.

BACKGROUND OF THE INVENTION

A fundamental problem surrounding oral hygiene is the storage of toothbrushes in between use. The human mouth is full of a plethora of bacterial species, and it is likely that some, if not most, of these bacteria are retained on the bristles of the brush after use. This is in addition to any food debris that might have been removed from mouth, and is now lodged within the bristles of the toothbrush. In many cases, repeated rinsing of the toothbrush with water is not sufficient enough to flush the contaminants from the bristles, and the toothbrush is then put in a drawer, on the counter or in a cabinet, and the like, for storage purposes. These warm and moist conditions then precipitate a supple breeding ground for further infestation of the toothbrush bristles by pre-existing and circulating bacteria and viruses. What is needed is an apparatus that is capable of storing a toothbrush in an antiseptic manner, while also protecting the toothbrush from any and all external contaminants.

There have been various incarnations within the prior art where attempts have been made to provide a sanitary toothbrush storage device. In particular, U.S. Pat. No. 6,119,854 discloses a sanitary storage unit, where the head of a toothbrush is immersed in an antiseptic fluid that is situated in a removable reservoir. U.S. Pat. No. 6,360,884 discloses an essentially rectangular storage container where the entire toothbrush is inserted into the container, and the bottom portion of the container possesses an aqueous antiseptic solution. Furthermore, multiples of these storage containers can be interconnected with each other. Additionally, U.S. Pat. No. 6,135,279 discloses a sanitizing toothbrush storage apparatus comprising an apparatus that raises and lowers platforms into and out of an aqueous solution that is stored in a container.

One common disadvantage to these and other toothbrush storage devices is the complexity in the design, leading to a greater expense being incurred during the manufacturing process, and this cost is then passed on to the consumer. Another disadvantage found in much of the prior art is again related to the complexity in the designs. The consequence of these intricate designs are various types of lids, elaborate mechanisms for inserting and retrieving the toothbrushes, mechanisms for mounting the apparatus to a wall, and the like. As a result, the plurality of moving parts and apertures contained in much of the prior art generates apparatuses that are hard to thoroughly clean. Circumspect cleaning of the apparatus will then provide a multitude of locales for contaminants to thrive, with this being counterintuitive to the initial premise behind the apparatus. What is lacking in the prior art is a sanitary toothbrush storage apparatus that is simplistic in design, providing for an efficiently manufactured, cost-effective toothbrush storage apparatus, and additionally, one that is simplistic to clean.

SUMMARY OF THE INVENTION

It is an object of the present invention to provide a sanitary toothbrush storage apparatus that addresses the aforementioned deficiencies in the prior art.

According to an aspect of the present invention, there is provided a sanitary toothbrush storage apparatus wherein the apparatus contains an aqueous antiseptic solution, the apparatus being so dimensioned and structured that when a toothbrush is placed within the apparatus, a portion of the toothbrush is immersed in a reservoir containing the aqueous antiseptic solution.

According to another aspect of the present invention, there is provided a sanitary toothbrush storage apparatus, comprising a substantially rectangularly shaped box comprising a base, a front wall, a back wall, a left wall and a right wall; a lid, that hinges on the front wall, providing for an enclosed internal hygienic environment; vertical dividing members communicating with the back wall, that partition the box into a plurality of compartments; a basket, comprising a lower region, a middle region, and an upper region, the lower region is substantially rectangularly shaped comprising a base, a front wall, a back wall, a left wall and a right wall, the face of the base is configured to allow for drainage of the aqueous antiseptic solution, the upper region contains an overhang for raising and lowering the basket, wherein the dimensions of the basket are configured to allow for insertion into one of the compartments.

According to yet another aspect of the present invention, there is provided a sanitary toothbrush storage apparatus, comprising a container comprising a base, a front wall, a back wall, a left wall and a right wall; a lid, that hinges on one of the walls, providing for an enclosed internal hygienic environment; and vertical dividing members communicating with at least one of the front or the back wall, for partitioning the container into a plurality of compartments; wherein the apparatus contains an aqueous antiseptic solution, such that when a toothbrush is placed within the apparatus, a head of the toothbrush is immersed in a reservoir containing the aqueous antiseptic solution.

The sanitary toothbrush storage apparatus of the present invention can be designed and manufactured to contain a plurality of compartments, which are capable of housing a plurality of toothbrushes. Preferably, the number of compartments in the sanitary toothbrush storage apparatus is four.

According to a further aspect of the present invention, there is provided small flanges, or lips, that are located on each of the right wall and on the left wall for the purpose of securing the apparatus to a wall via a bracket. The bracket comprises a substantially rectangularly shaped vertical member that accommodates a means for attachment to a wall in an upper section and in a lower section; a horizontal member that forms a substantially rectangularly shaped ring that intersects and is attached to or integrally formed with the vertical member forming a T-shaped configuration, where the dimensions of the aperture are somewhat larger than the dimensions of the sanitary toothbrush apparatus; wherein when the sanitary toothbrush apparatus is deposited into the ring, the flanges rest on the aperture, and support the apparatus.

According to a further preferred embodiment of the present invention, it is contemplated that the bracket further comprises a protrusion that extends outward from the bottom of the vertical member, wherein the protrusion imparts a platform that provides support for the sanitary toothbrush storage apparatus. It is further contemplated that there is a second vertical member that introduces the end of the protrusion to the horizontal member, wherein the protrusion, the first vertical member, the second vertical member and the horizontal member impart an enclosure that provides support for the sanitary toothbrush storage apparatus.

According to a preferred embodiment of the present invention, the sanitary toothbrush storage apparatus comprises a pin that secures the lid to the storage apparatus within the hinge, and this allows for the lid to pivot about the hinge in open and closed positions. Further, the sanitary toothbrush storage apparatus comprises a first snap closure means and the wall of the apparatus opposing the lid comprises a second snap closure means that are capable of retaining the lid in a closed position.

According to another preferred embodiment of the present invention, the sanitary toothbrush storage apparatus has at least one basket that is introduced to the compartments of the apparatus for supporting small oral hygiene implements. In particular, the small oral hygiene implements are selected from the group consisting of electric-toothbrush heads and rubber picks.

According to yet another preferred embodiment of the present invention, the sanitary toothbrush storage apparatus is mounted to a wall, preferably through the aforementioned bracket. However, other means of mounting the toothbrush storage apparatus to a vertical surface will be apparent to one skilled in the art. Additionally, the sanitary toothbrush storage apparatus may sit vertically upright on a flat horizontal surface, such as a bathroom counter, either through the base according to the present invention, or through the use of some sort of holder that would be apparent to one skilled in the art.

According to a further aspect of the present invention, there is provided a sanitary toothbrush storage apparatus wherein the apparatus is a substantially cylindrical tube, comprising an upper section; and a bottom section; wherein the top half and bottom half are constructed to allow for a sealed connection to retain an aqueous antiseptic solution therein, such that when a toothbrush is placed within the apparatus, a head of the toothbrush is immersed in the aqueous antiseptic solution.

The sealed connection may be generated through a threaded means or a snap means, and the seal itself is attained through the use of a gasket, particularly a rubber gasket.

According to a still further preferred embodiment of the present invention, the bottom half of the cylindrical tube further comprises walls that are substantially flared in shape as they descend down to a base, wherein the flared shape imparts a broadened base that provides for an inherent level of stability when the apparatus is placed upright on a horizontal surface.

The aqueous antiseptic solution that is utilized in the present invention is selected from the group consisting of mouthwash, an antibacterial solution, an antiseptic solution, a germicidal solution and any combination thereof. Preferably the antiseptic solution is mouthwash, particularly any commercially available mouthwash that exhibits an antiseptic quality.

It is to be understood that all aspects of the present invention may be composed of any material that is known in the art. Preferably, the material is dishwasher safe, to allow for simple and easy cleaning of the apparatus. In particular, the sanitary toothbrush storage apparatus is essentially composed of a material selected from the group consisting of porcelain, ceramic, stainless steel, plastic and any combination thereof. In addition, the sanitary toothbrush storage apparatus may come in any colour, and be decorated with a plethora of designs, decals and other various decorative additions that provide for aesthetically pleasing designs to appease any and all eclectic tastes.

Further scope of applicability of the present invention will become apparent from the detailed description given hereinafter. However, it should be understood that the detailed description, while indicating preferred embodiments of the present invention, are given by way of illustration only, since various changes and modifications within the spirit and scope of the invention will become apparent to those skilled in the art.

BRIEF DESCRIPTION OF THE DRAWINGS

The present invention will now be described in more detail having regard to the Drawings, in which.

DETAILED DESCRIPTION OF THE INVENTION

A better understanding of the present invention and its objects and advantages will become apparent to those skilled in this art form the following detailed description, wherein there is described only the preferred embodiment of the invention, simply by way of illustration of the best mode contemplated for carrying out the invention. As will be realized, the invention is capable of modifications in various obvious respects, all without departing from the scope and spirit of the invention. Accordingly, the description should be regarded as illustrative in nature and not as restrictive.

Figure 1:
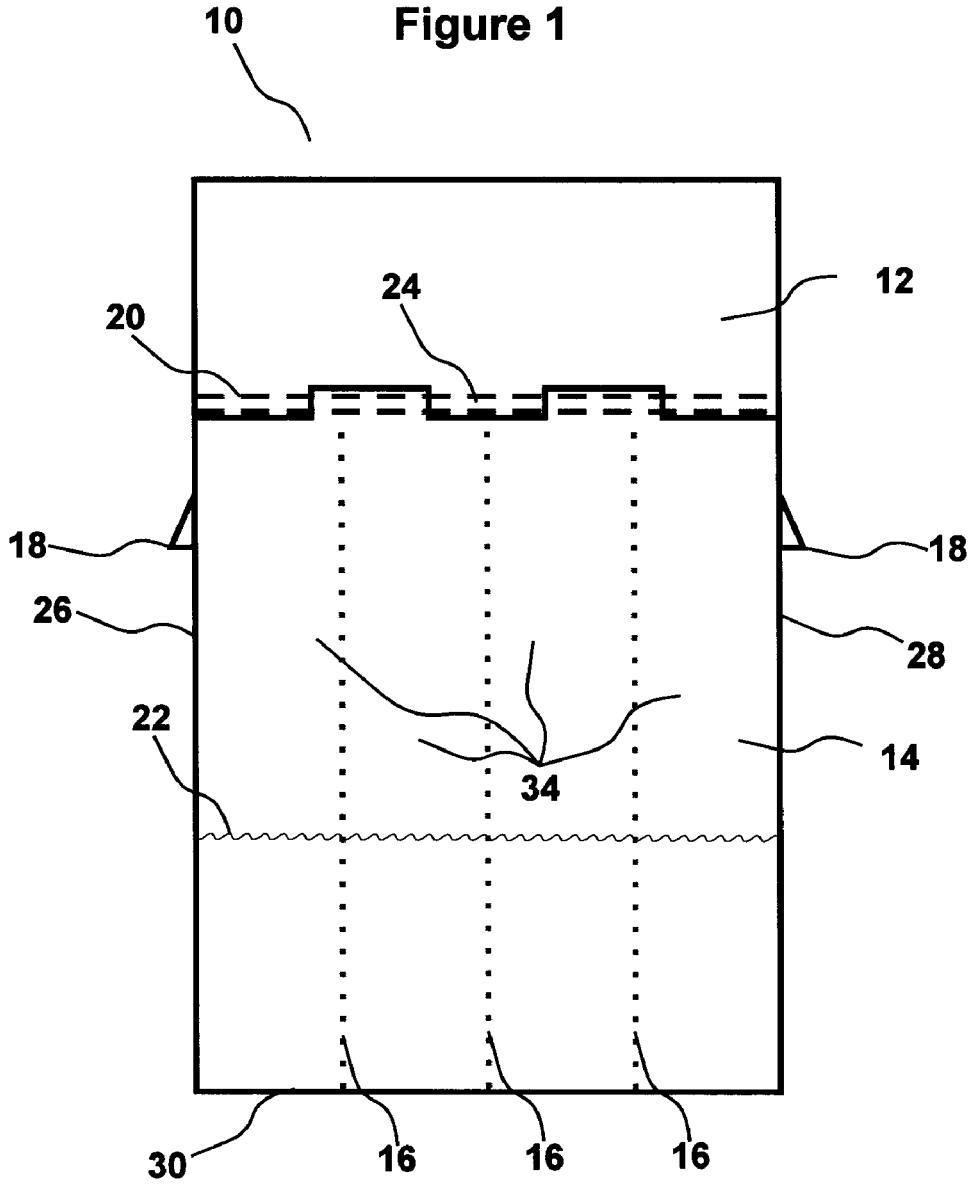
FIG. 1 shows a front view of the toothbrush storage apparatus of the present invention.

FIG. 1 depicts an embodiment of the sanitary toothbrush storage apparatus (10), which comprises a lid (12), and a rectangularly shaped box (14). The box (14) further comprises a back wall (32), a front wall (31), a left wall (26), a right wall (28) and a base (30). The height of the entire storage apparatus (10) is preferably approximately eight inches. This height is preferred as it is marginally longer than the length of most toothbrushes, providing for easy retrieval of toothbrushes once they are placed with in the storage apparatus (10), as the toothbrush handles will be easily accessible once the lid (12) is retracted. The lid (12) is attached to the box (14) about a hinge (24), where the hinge contains a pin member (20). The hinge (24) mechanism allows the lid to pivot about the box (14) into both an open and closed configuration. As illustrated in FIG. 1, the top of the back wall (32) may have a first snap closure means (36) and the lid (12), a second corresponding snap closure means (38) for retaining the lid in the closed configuration. Although any means known to one of skill in the art that is capable of retaining the lid (12) in a closed position is also contemplated within the present invention. According to one embodiment of the present invention, the upper section of the box (14) is fitted with a flange (18) on both the right wall (28) and the left wall (26). These flanges are utilized for mounting the sanitary toothbrush storage apparatus (10) to a wall, or any other vertical member, such as the side of a cabinet. Within the box (14), it is contemplated that there may exist vertical dividing members (16) that divide the box (14) into a plurality of compartments (34). These compartments (34) would allow for the separation of toothbrushes when there are multiple toothbrushes within the apparatus (10). These vertical dividing members (16) may comprise an integral wall unit that traverses the height and depth of the box (14), whereby the compartments (34) are entirely occluded from each other. Alternately, the vertical dividing members (16) may form partial wall units, whereby some communication subsists between compartments (34), but the compartments (34) themselves are clearly delineated. The sanitary toothbrush storage apparatus (10) can be designed to include from one to ten compartments (34), preferably there are four compartments (34).

When in use, the lower section of the box (14) of the sanitary toothbrush storage apparatus (10) is filled with an aqueous antiseptic solution (22) to a height sufficient enough to completely submerse an intended oral hygiene implement, such as the head of a toothbrush. The aqueous antiseptic solution (22) can be any one of mouthwash, an antibacterial solution, an antiseptic solution, a germicidal solution or any combination thereof, or any sanitizing solution known to one skilled in the art that is approved for human consumption. Preferably, the aqueous antiseptic solution (22) is mouthwash. When it is desirous that the current aliquot of antiseptic solution (22) be replaced, the lid (12) is arranged into the open configuration, and the storage apparatus (10) is manually inverted over an appropriate receptacle or drain. The antiseptic solution (22) is then dissipated from the storage apparatus (10), and new antiseptic solution (22) is then manually deposited into the now righted storage apparatus (10).

Figure 2:
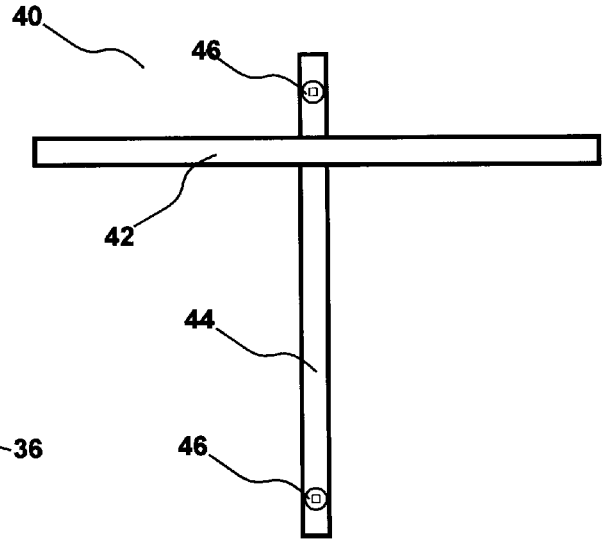
FIG. 2 shows a front view of a bracket for the toothbrush storage apparatus of the present invention.
Figure 3:
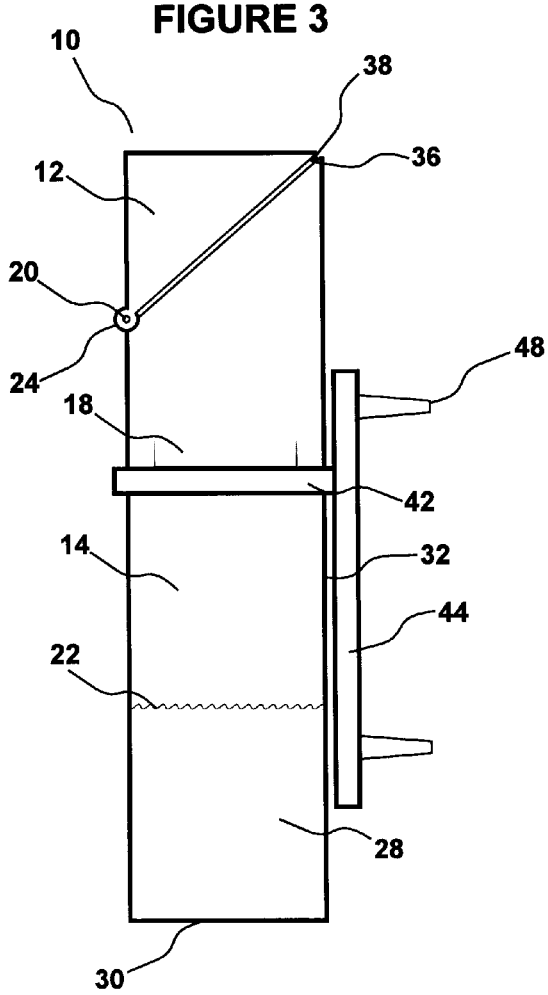
FIG. 3 shows a side view of the toothbrush storage apparatus of the present invention whilst it is interacting with the bracket of FIG. 2.

As can be seen in FIGS. 2 and 3, in another preferred embodiment of the present invention, the sanitary toothbrush storage apparatus (10) may comprise a wall mounting means in the form of a bracket (40). The bracket consists of a vertical member (44) and a horizontal member (42), where the horizontal member (42) is essentially a rectangularly shaped ring. The dimensions of the interior of the ring-shaped horizontal member (42) are somewhat larger than those of the box (14), and are configured as such to allow for a snug placement of the apparatus (10) into the horizontal member (42). The horizontal member (42) intersects the vertical member (44) to form a substantially T-shaped device. At the upper and lower sections of the vertical member (44), there are apertures (46) that allow for insertion of a screw or nail, or any other type of means suitable for mounting the bracket (40) to a vertical surface known to one skilled in the art. On the rear of the vertical member (44), there are retainers (48) that extend outward at corresponding positions to the apertures (46). The retainers (48) bolster the strength of attachment of the bracket (40) to a vertical surface when a screw is utilized, and the exact nature of the retainers (48) would be known to one skilled in the art.

As can be seen in FIG. 3, the sanitary toothbrush storage apparatus (10) can be inserted into the horizontal member (42) of the bracket (40), and as the sanitary toothbrush storage apparatus (10) is lowered through the horizontal member (42), the flanges (18) that are located on the left and right walls (26, 28) of the box (14) will come into contact with the horizontal member (42), and support the box (14) about the bracket (40). This allows for convenient mounting of the apparatus (10) to any vertical surface.

Figure 5:
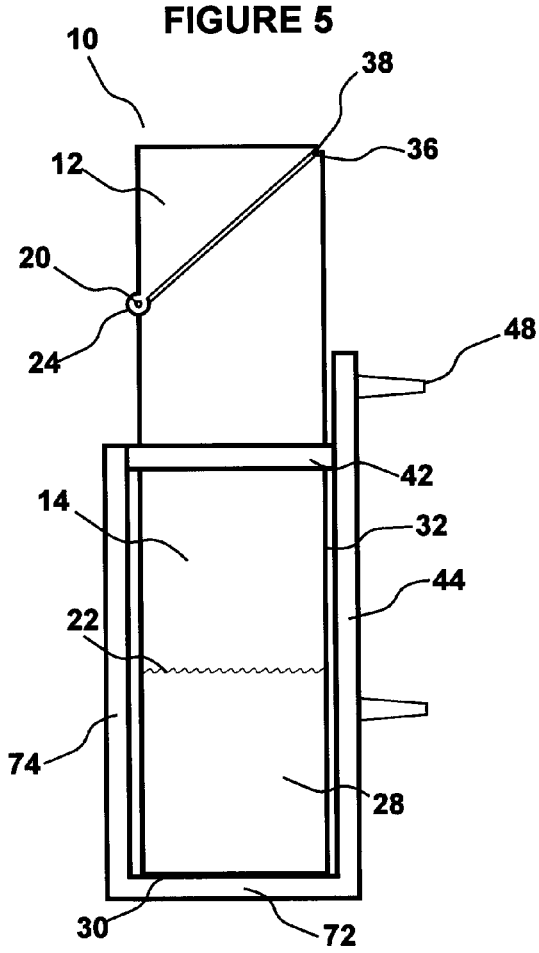
FIG. 5 shows a side view of the toothbrush storage apparatus of the present invention whilst it is interacting with a further embodiment of the bracket of FIG. 2.
Figure 4:
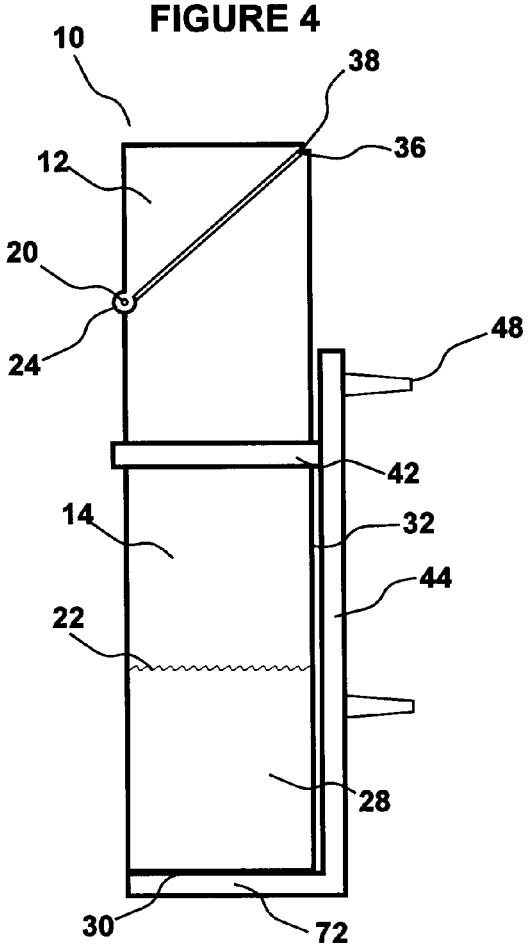
FIG. 4 shows a side view of the toothbrush storage apparatus of the present invention whilst it is interacting with another embodiment of the bracket of FIG. 2.

As can be seen in FIGS. 4 and 5, in additional preferred embodiments of the present invention, there is provided a bracket (40) for securing the sanitary toothbrush storage apparatus (10) to a vertical surface. The bracket (40) comprises all of the features as those listed above, however, in one embodiment of the present invention, it is contemplated that there exists a base member or protrusion (72) that extends outward from the bottom of the vertical member (44). The length of the base member or protrusion (72) corresponds to the depth of the box (14) of the sanitary toothbrush storage apparatus (10) and is thus enabled to provide support for the apparatus (10). In another embodiment of the present invention, it is further contemplated that at the end of the base member (72), at a length long enough to accommodate the depth of the box (14) of the apparatus (10), there exists a second vertical member (74) that connects the base member (72) to the horizontal member (42). Also, whereas the flanges (18) present on the box (14) are designed to support the toothbrush storage apparatus (10) within the bracket, in these embodiments, the base (30) of the box (14) will rest upon the base member (72) to support the apparatus (10). Accordingly, in these embodiments, the flanges (18) are no longer necessary, and are not envisaged on the box (14) of the apparatus (10). These embodiments provide for a design that is more straightforward, and thus, will equate to a simpler manufacturing process.

Figure 6:
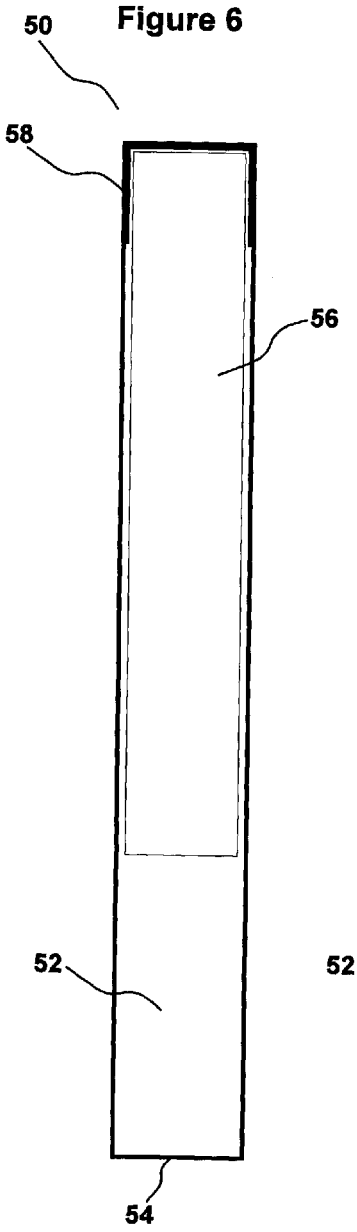
FIG. 6 shows a front view of a basket for the toothbrush storage apparatus of the present invention.
Figure 7:
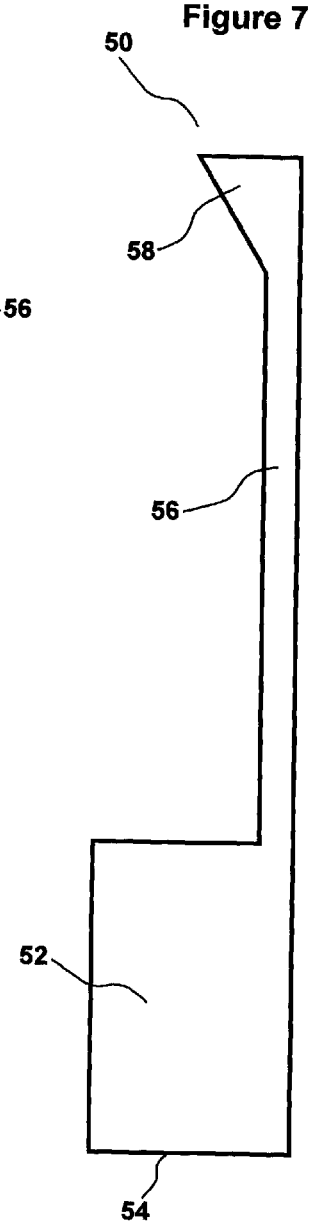
FIG. 7 shows a side view of a basket for the toothbrush storage apparatus of the present invention.
Figure 8A:
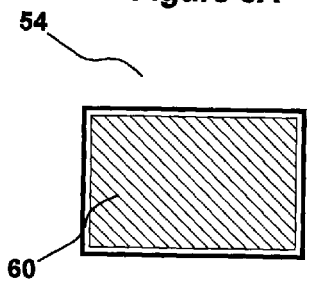
FIGS. 8A, 8B and 8C show alternate embodiments of the configuration of the base of the basket for the toothbrush storage apparatus of the present invention.
Figure 8B:
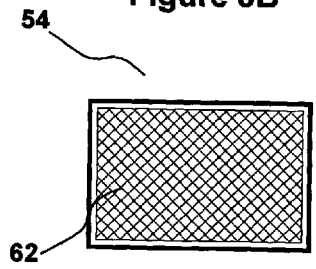
Figure 8C:
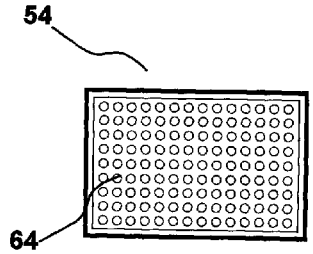

As can be seen in FIGS. 6 and 7, in another preferred embodiment of the present invention, there is provided a basket (50) that may be inserted into the sanitary toothbrush storage apparatus (10). The basket (50) is comprised of a lower section (52) and an upper section (56). The lower section (52) is a substantially rectangularly shaped box that is open on the top. The upper section (56) extends vertically and may have an overhang (58) at the top. This overhang (58) provides the means to grasp the basket (50) while it is being raised and lowered into and out of the aqueous antiseptic solution (22) of the sanitary toothbrush storage apparatus (10). The dimensions of the basket (50) are configured such that the basket (50) can be easily inserted and removed from the compartments (34) of the sanitary toothbrush storage apparatus (10). Furthermore, the bottom face (54) of the lower section (52) of the basket (50) is structured so as to allow for drainage of the aqueous antiseptic solution (22) when the basket (50) is being raised or removed from the sanitary toothbrush storage apparatus (10). FIG. 8A to 8C illustrate some of the preferred embodiments of the present invention, where a grate-like construction (60), a mesh-like construction (62), or a perforated type construction (64) would allow for proper drainage of the solution out of the basket (50). Alternately, designs that accomplish a similar endpoint that would be apparent to one skilled in the art may also be employed.

When the sanitary toothbrush storage apparatus (10) is in use, the lid (12) is repositioned from the closed positioned to that of an open position. A toothbrush is inserted into one of the compartments (34), or, if it is desirous to store a shorter oral hygiene implement, such as an electric toothbrush head, the oral hygiene implement is first placed in a basket (50) and then the basket (50) is inserted into one of the compartments (34). The sanitary toothbrush storage apparatus (10) is filled with an amount of aqueous antiseptic solution (22) to a height sufficient enough to submerse the oral hygiene implement or the head of a toothbrush. The lid (12) is then repositioned from the open position to that of a closed position, providing a dust-free sanitary environment for the storage of oral hygiene implements. For retrieving the toothbrush, the lid (12) is again repositioned from the closed position to that of an open position. The handle of a toothbrush is then readily accessible, and the toothbrush is withdrawn from the apparatus (10), and the lid (12) is again returned to the closed configuration. When a small oral hygiene implement is stored, upon opening the lid (12), the basket (50) containing the small oral hygiene implement is withdrawn from a compartment (34) by grasping the overhang (58) at the top of the basket (50). The small oral hygiene implement is then removed from the basket (50), and the basket (50) is then either returned to the compartment (34), or may be stored in a different location if it is no longer necessary, and the lid (12) is returned to the closed configuration.

Figure 9:
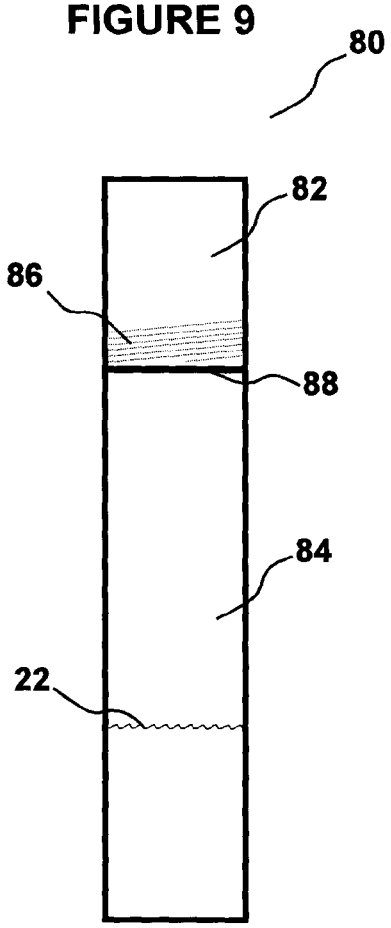
FIG. 9 shows a front view of an alternative embodiment of the present invention.

As can be seen in FIG. 9, in another preferred embodiment of the present invention, there is provided a travel sanitary toothbrush storage apparatus 80. The travel sanitary toothbrush storage apparatus 80 is substantially cylindrical or tube shaped and is comprised of an upper section 82 and a lower section 84. The upper section 82 is attached to the lower section 84 by, for example a threaded means 86 as illustrated in FIG. 9, however, other means known to one skilled in the art, such as a snap means (not shown), may also be utilized. At the connection point between the upper section and the lower section 84, there is a rubber ring 88, which provides for a watertight seal. Alternatively, other means that provide a watertight seal known to one skilled in the art may also be used, such as a gasket.

Figure 10:
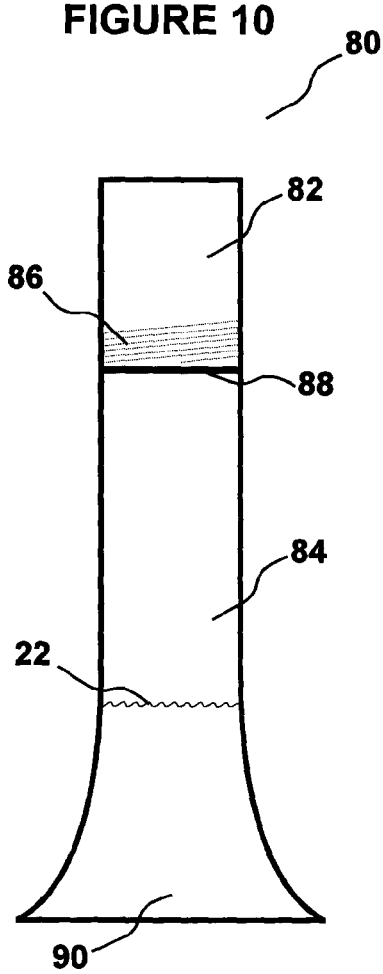
FIG. 10 shows a front view of an alternative embodiment of the present invention.

As can be seen in FIG. 10, in another preferred embodiment of the present invention, there is provided a travel sanitary toothbrush storage apparatus (80). The travel sanitary toothbrush storage apparatus (80) comprises all of the features as listed above, however, in this embodiment of the present invention, it is contemplated that the base (90) of the lower section (84) is substantially flared. Flaring the shape of the lower section (90) will result in the broadening of the base (90), allowing for an increased inherent level of stability when the travel toothbrush storage apparatus (80) is placed upright, with the base (90) on a horizontal surface, such as a counter or table.

When the travel sanitary toothbrush storage apparatus (80) is in use, an oral hygiene implement is inserted into the lower section (84). The lower section (82) of the travel sanitary toothbrush storage apparatus (80) is then filled with an aqueous antiseptic solution (22) to a height sufficient enough to submerse at least a portion of the oral hygiene implement, such as the head of a toothbrush. The upper section (82) is then fastened to the lower section (84), providing a watertight seal, and containing and storing the oral hygiene implement in a dust-free and sanitary environment. These embodiments of the present invention allow for the storage and sanitization of a toothbrush for use in a traveling environment.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

Industrial Applicability

The invention provides a sanitary toothbrush storage apparatus which contains an aqueous antiseptic solution. When a toothbrush is placed within the apparatus, a portion of the toothbrush is immersed in a reservoir containing the aqueous antiseptic solution. The present invention provides a sanitary toothbrush storage apparatus that is simplistic in design, providing for an efficiently manufactured, cost-effective toothbrush storage apparatus, and additionally, one that is simplistic to clean.

The embodiments of the present invention in which an exclusive property or privilege is claimed are defined as follows:

1. A sanitary toothbrush storage apparatus, comprising:
- a container of unitary construction comprising a base, a front wall, a back wall, a left wall and a right wall;
- a lid, that hinges on one of the walls, providing for an enclosed internal hygienic environment;
- at least one vertical dividing member communicating with the front and/or the back wall, for partitioning the container into a plurality of equally dimensioned compartments; and
- individual baskets disposed in the plurality of compartments for supporting oral hygiene implements, each basket capable of movement in the apparatus independent of the others and comprising a lower region and an upper region, wherein:
  - each lower region comprises a base, a front wall, a back wall, a left wall and a right wall, and is shaped and dimensioned for fitted insertion and removal from a compartment;
  - each upper region comprises an overhang connected to the lower region by a vertical portion; and
  - each base is configured to allow for drainage of an aqueous antiseptic solution;
- wherein the dividing members allow fluid communication between the plurality of compartments; and
- wherein the container is liquid tight to retain the aqueous antiseptic solution.

2. The sanitary toothbrush storage apparatus according to claim 1, wherein the base of each basket is configured in a construction selected from the group consisting of a grate-like construction, a mesh-like construction and a perforated construction.

3. The sanitary toothbrush storage apparatus according to claim 1, wherein the number of compartments is four.

4. The sanitary toothbrush storage apparatus according to claim 1, further comprising a flange located on each of the right wall and the left wall.

5. The sanitary toothbrush storage apparatus according to claim 4, further comprising a bracket for mounting the apparatus to a wall, wherein the bracket comprises:
- a substantially rectangularly shaped vertical member that accommodates a means for attachment to a wall in an upper section and in a lower section;
- a horizontal member that forms a substantially rectangularly shaped ring that intersects and is attached to the vertical member forming a T-shaped configuration, where the dimensions of the ring are somewhat larger than the dimensions of the sanitary toothbrush apparatus;

wherein when the sanitary toothbrush apparatus is deposited into the ring shaped horizontal member, the flanges rest on the horizontal member, and support the apparatus.

6. The sanitary toothbrush storage apparatus according to claim 1, further comprising a bracket for mounting the apparatus to a wall, wherein the bracket comprises:

a substantially rectangularly shaped vertical member that accommodates a means for attachment to a wall in an upper section and in a lower section;

a horizontal member that forms a substantially rectangularly shaped ring that intersects and is attached to the vertical member forming a T-shaped configuration, where the dimensions of the ring are somewhat larger than the dimensions of the sanitary toothbrush apparatus;

a protrusion that extends outward from the bottom of the vertical member;

wherein when the sanitary toothbrush apparatus is deposited into the ring shaped horizontal member the protrusion imparts a platform that provides support for the sanitary toothbrush storage apparatus.

7. The sanitary toothbrush storage apparatus according to claim 6, wherein the bracket further comprises:

a second vertical member that introduces the end of the protrusion to the horizontal member, wherein the protrusion, the first vertical member, the second vertical member and the horizontal member impart an enclosure that provides support for the sanitary toothbrush storage apparatus.

8. The sanitary toothbrush storage apparatus according to claim 1, wherein a pin secures the lid to the storage apparatus within the hinge, allowing for the lid to pivot about the hinge in open and closed positions.

9. The sanitary toothbrush storage apparatus according to claim 1, wherein the lid comprises a first snap closure means and the wall of the apparatus opposing the lid comprises a second snap closure means to retain the lid in a closed position.

10. The sanitary toothbrush storage apparatus according to claim 1, wherein the apparatus is mounted to a wall.

11. The sanitary toothbrush storage apparatus according to claim 1, wherein the apparatus sits vertically upright on a flat horizontal surface.

12. The sanitary toothbrush storage apparatus according to claim 1, wherein the aqueous antiseptic solution is selected from the group consisting of mouthwash, an antibacterial solution, an antiseptic solution, a germicidal solution and any combination thereof.

13. The sanitary toothbrush storage apparatus according to claim 1, wherein the aqueous antiseptic solution is mouthwash.

14. The sanitary toothbrush storage apparatus according to claim 1, wherein the apparatus is essentially composed of a material selected from the group consisting of porcelain, ceramic, stainless steel, plastic and any combination thereof.

* * * * *